United States Patent [19]

Kim

[11] Patent Number: 5,002,083

[45] Date of Patent: Mar. 26, 1991

[54] TENT COVER RETAINING DEVICE

[75] Inventor: Soon-Tae Kim, Seoul, Rep. of Korea

[73] Assignee: Baejin Corporation, Seoul, Rep. of Korea

[21] Appl. No.: 390,489

[22] Filed: Aug. 1, 1989

Related U.S. Application Data

[63] Continuation of Ser. No. 117,679, Nov. 5, 1987, abandoned.

[51] Int. Cl.[5] ..... E04H 15/28

[52] U.S. Cl. ..... 135/98; 135/102; 135/105; 135/109; 135/119

[58] Field of Search ..... 135/105, 104, 103, 98, 135/109, 102, 115, 119

[56] References Cited

U.S. PATENT DOCUMENTS

| | | | |
|---|---|---|---|
| 3,181,542 | 5/1965 | Bareis | 52/109 |
| 3,371,671 | 3/1968 | Kirkham | 135/105 |
| 3,499,457 | 3/1970 | Waring | 135/105 |
| 3,502,091 | 3/1970 | Corbin | 135/109 |
| 3,794,054 | 2/1974 | Watts | 135/104 |
| 3,929,146 | 12/1975 | Maiken | 135/98 |
| 4,003,181 | 1/1977 | Robinson et al. | 52/745 |
| 4,202,363 | 5/1980 | Watts | 135/98 |
| 4,352,362 | 10/1982 | Nichols | 135/98 |
| 4,665,935 | 5/1987 | Nichols | 135/104 |
| 4,750,509 | 6/1988 | Kim | 135/102 |
| 4,809,726 | 3/1989 | Gillis | 135/109 |

*Primary Examiner*—David A. Scherbel
*Assistant Examiner*—Lan Mai
*Attorney, Agent, or Firm*—Donald C. Feix

[57] ABSTRACT

A tent cover retaining device is disclosed for tents having an exterior frame supporting a tent fabric. A hook extends integrally from each frame member, adjacent to a folding joint, and a rubber string secured to the tent cover is connected to the hook. This prevents the tent cover from slipping down when the frame members adjacent to the joint are folded with the joint upward. The tent cover of the folded tent is stabilized in position and is not permitted to slide loosely on the tubular tent frame component. This is particularly important when the tent is re-erected and the frame is unfolded.

2 Claims, 2 Drawing Sheets

TENT COVER RETAINING DEVICE

This is a continuation of copending application Ser. No. 07/117,679 filed on Nov. 5, 1987.

FIELD OF THE INVENTION

The present invention relates to foldable tents, and particularly to a device for preventing a tent cover from slipping on a frame, such that the tent cover will not slip down or generate loose movements when the tent is folded.

BACKGROUND OF THE INVENTION

Generally a foldable tent comprises a frame and a cover in combination. The frame in one type of construction has a radially extended and downwardly curved configuration, with the cover installed inside this framework, the connecting portions of the tent fabric cover being shaped as sleeves or tubes in order for them to be attached to the framework. U.S. Pat. No. 4,750,509 shows this general type of construction.

In the construction of such conventional tents, there is a problem in that each time a tent is folded, the cover tends to slip down at the joints, requiring the user to pull up and hold the cover in position each time the tent is folded and particularly when the tent is unfolded.

As shown in the prior art view of FIG. 4, the cover slips down along the frame as the frame is folded. The cover has to be pulled up when unfolding and erecting the tent. Further there is another disadvantage of the prior art tent in that the cover is always biased to one side after installation of the tent due to the longitudinal movements of the fabric sleeves.

SUMMARY OF THE INVENTION

It is an object of the present invention to provide a tent structure in which the above-described disadvantages of conventional tents are overcome, and in which the cover does not slip down and does not displace laterally along the tent frame, but maintains the proper position.

DETAILED DESCRIPTION OF PREFERRED EMBODIMENT

Figure 3:
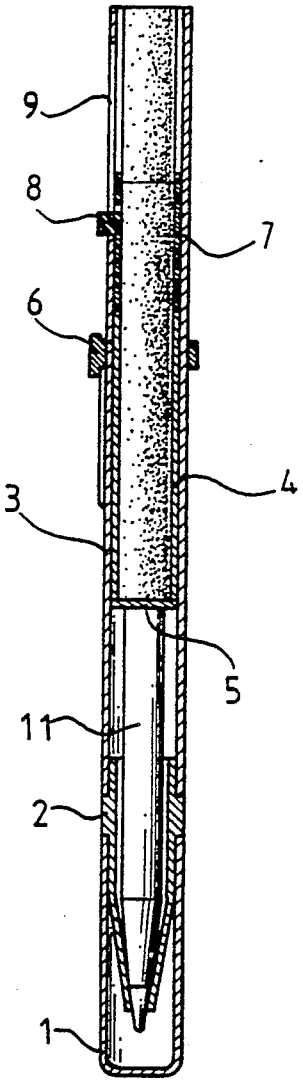
FIG. 3 is an elevation view illustrating the folding of the tent frame and retention of the tent cover in place according to the present invention.
Figure 1:
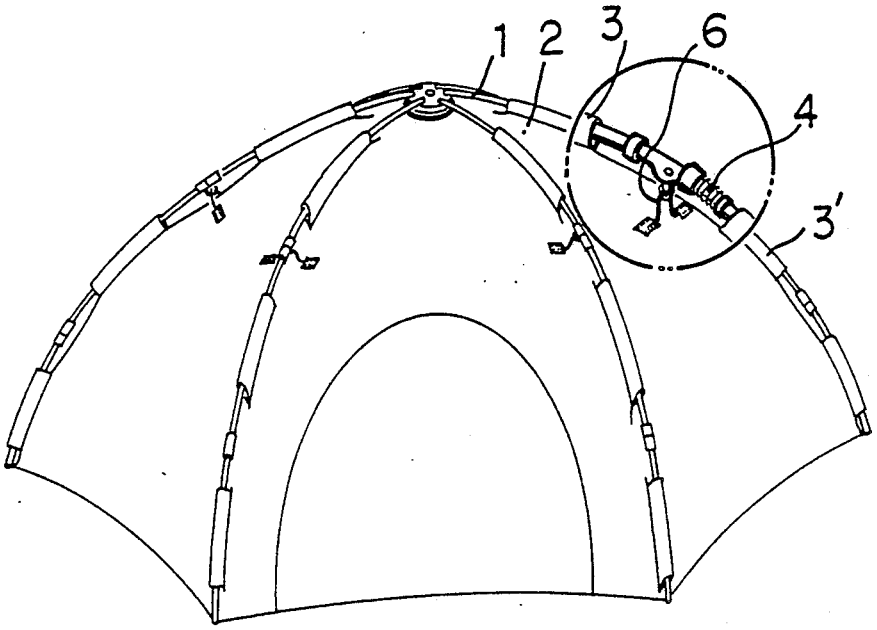
FIG. 1 is a perspective view showing an exterior-frame tent construction with fabric sleeves or tubes for retaining a tent cover to a tent frame, including the improvement according to the present invention.
Figure 2:
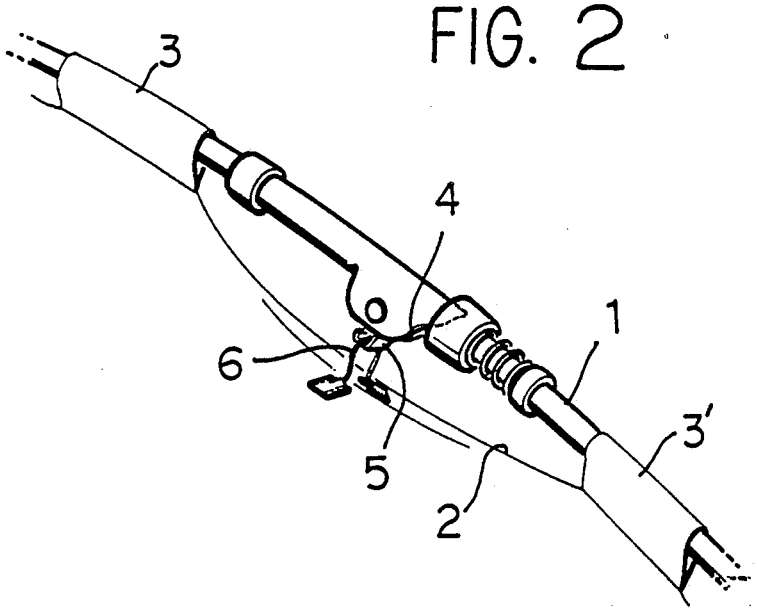
FIG. 2 is a perspective view showing in detail the improvement of the present invention.
Figure 1:
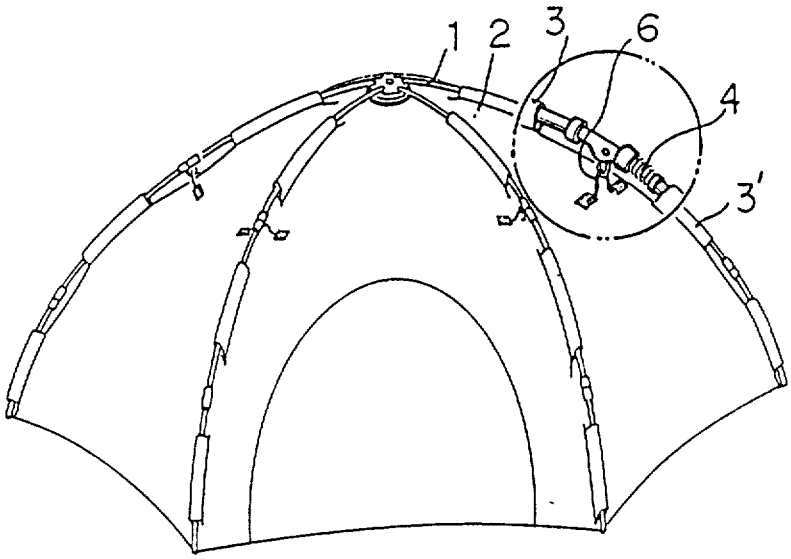
Figure 2:
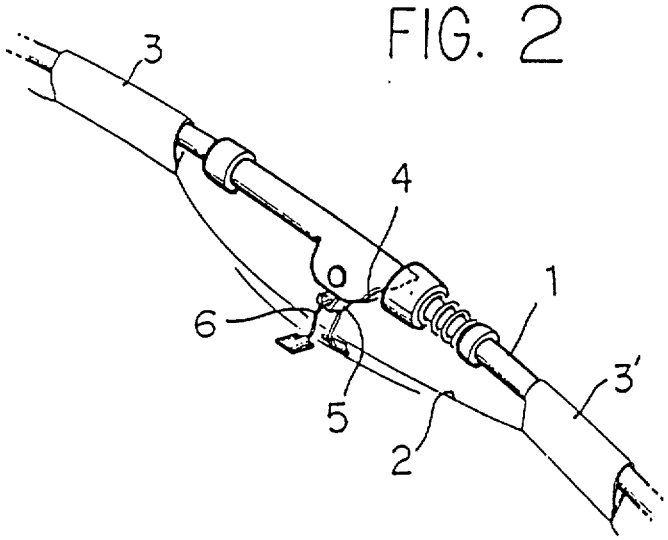
Figure 3:
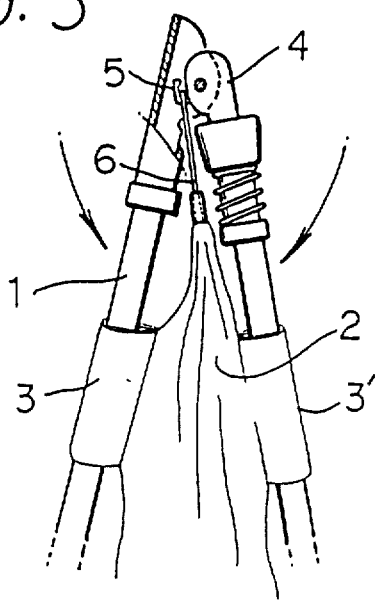
Figure 4:
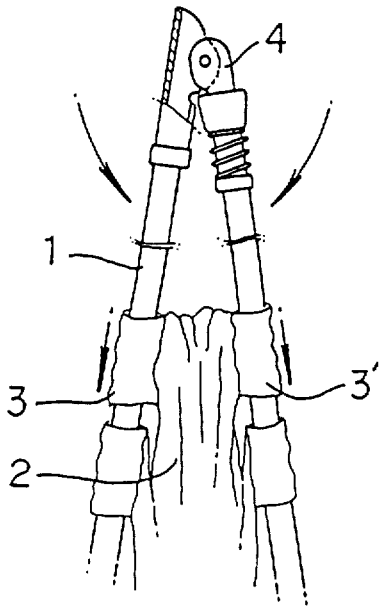

The assembly of the tent can be carried out by inserting the frame 1 into fabric sleeves 3, 3' of a tent cover 2. A hook 5 is integrally formed with the ends of folding tubes 4 which function as joints for the tent frame 1. A flexible band 6 is installed at each interval between adjacent fabric sleeves 3, 3' which are permanently secured to the cover 2. The band 6 is hung on the hook 5 as illustrated in FIGS. 1, 2 and 3. The tip of the hook preferably is inwardly bent as shown in order to prevent the disengagement of the flexible band 6. Hooks 5 and flexible bands 6 may be provided only at the folding tubes 4 or, in an alternate embodiment, more extensively. The flexible band 6 may be made of rubber or other material such as a rope.

The folding tent construction of the present invention as shown in FIGS. 1 and 2 will always maintain the tent cover 2 at the proper position without allowing it to slip down or move loosely on the frame when the tent is folded to the storage configuration. The flexible band 6, extending from the tent fabric and to the hook 5 of the tent frame, preventing such slipping.

As shown in FIG. 3, in comparison with FIGS. 1 and 2, when the frame 1 is folded up, the frame's top center moves down (FIG. 3 shows the sleeve 3 swung downwardly from the joint). The joints 4 remain extending upwardly. The tent cover 2 does not slip down, but remains suspended by the bands 6 at the proper position. As can be envisioned from FIGS. 1 and 3 and as is well known in exterior-frame tents of this type, the next joint below the sleeve 3' is down against the ground during folding, with the lowermost section of the frame leg extending upwardly.

As can be envisioned from FIGS. 1 and 3 and as is well known in exterior-frame tents of this type, the next joint below the sleeve 3' is down against the ground during folding, with the lowermost section of the frame leg extending upwardly.

Figure 4:
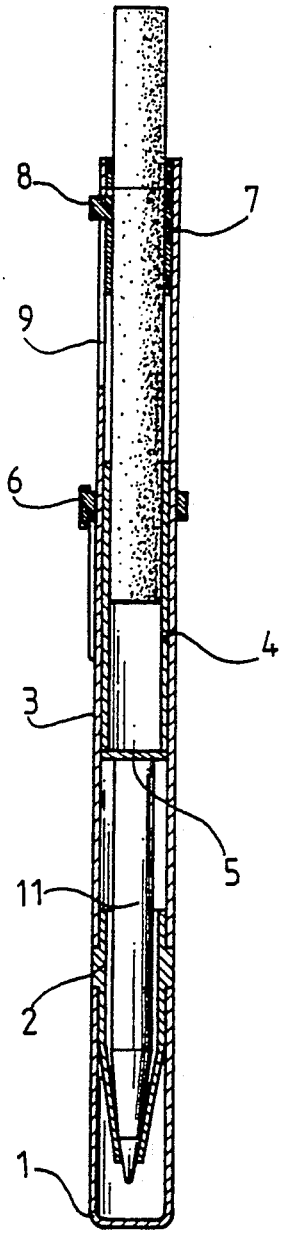
FIG. 4 shows the construction of a conventional tent of the prior art in which the slipping-down of the tent cover is illustrated.

Therefore, when the tent is being unfolded for erection, the cover 2 need not be held up manually but is held by the device of the invention at its properly raised and centered position about the joint as shown in FIG. 3. In external-fame folding tents of this type, the device of the invention provides for much greater convenience compared with the conventional tent construction as shown in FIG. 4. Without any holding device at the joint, the conventional construction shown in FIG. 4 allows the cover to slip down when the frame is folded, as illustrated.

I claim:

1. In a foldable tent of the type having an external foldable frame formed of a plurality of foldable legs which extended generally radially from a top center member and wherein each of the legs is made up of leg sections and folds about pivot joints so that, in folded configuration, at least one upwardly extending apex is formed in each folded leg, and the legs when unfolded supporting a tent cover in a space interior of the legs, by flexible supporting sleeves secured to the tent cover and extending slidingly over individual sections of each leg, with the pivot joints between leg sections not covered by the supporting sleeves, the improvement comprising, positioning means attached to the tent cover and to the pivot joints which form upward apexes in the folded configuration of the tent for keeping the supporting sleeves in appropriate positions near the pivot joints to assure smooth operation when unfolding the tent, said positioning means including a flexible string which limits sliding of a supporting sleeve down an associated leg section so as to eliminate any need for the user to pull up and to hold the supporting sleeve in position each time the tent is unfolded, and wherein said positioning means are constructed and are attached to the pivot joints in a way so as not to affect the support of the tent cover from the legs by the supporting sleeves when the foldable tent is fully unfolded and opened.

2. The apparatus defined in claim 1 wherein the flexible string is a rubber string.

* * * * *

UNITED STATES PATENT AND TRADEMARK OFFICE

CERTIFICATE OF CORRECTION

PATENT NO. : 5,002,083

DATED : March 26, 1991

INVENTOR(S) : Soon-Tae Kim

It is certified that error appears in the above-identified patent and that said Letters Patent is hereby corrected as shown below:

Sheet 1 of 2 consisting of Drawing Figs. 3 and 4, should be deleted to be replaced with Figure 1 and 2 as shown on the attached sheet.

Sheet 2 of 2 consisting of Drawing Figs. 1 and 2 should be deleted to be replaced with Figs. 3 and 4 as shown on the attached sheet.

Signed and Sealed this

Twenty-first Day of September, 1993

Bruce Lehman

*Attest:*

BRUCE LEHMAN

*Attesting Officer*

*Commissioner of Patents and Trademarks*